United States Patent [19]

Creedon

[11] Patent Number: 4,681,015

[45] Date of Patent: Jul. 21, 1987

[54] RAIL GUN BARREL WITH AXIALLY PRESTRESSED INSULATORS

[75] Inventor: Richard L. Creedon, San Diego, Calif.

[73] Assignee: GA Technologies Inc., San Diego, Calif.

[21] Appl. No.: 756,038

[22] Filed: Jul. 17, 1985

[51] Int. Cl.[4] ..... F41F 1/02

[52] U.S. Cl. ..... 89/8; 124/3

[58] Field of Search ..... 89/8, 16, 15, 14.05, 89/14.1; 42/76 R, 76 A; 124/3; 310/11-14

[56] References Cited

U.S. PATENT DOCUMENTS

| | | | |
|---|---|---|---|
| 595,464 | 12/1897 | Blood | 89/16 |
| 821,331 | 5/1906 | Blood | 89/16 |
| 1,772,507 | 8/1930 | Barnes | 89/16 |
| 3,228,298 | 1/1966 | Grandy et al. | 89/16 |
| 3,727,513 | 4/1973 | Wicks | 89/14.05 X |
| 4,211,146 | 7/1980 | Bradley | 89/16 |
| 4,424,734 | 1/1984 | Janssen et al. | 89/16 |

OTHER PUBLICATIONS

R. A. Marshall, "Railgun Overview", Proceedings of the Impact Fusion Workshop, Los Alamos Scientific Lab., Los Alamos, NM, 7/12/79.

R. S. Hawke et al., "Results of Railgun Experiments . . . ", IEEE Transactions on Magnetics, vol. 18, No. 1, Jan. 1982.

J. W. Ryan, "Guns, Mortars & Rockets", Brassey's Published Limited, 1982, pp. 51-55.

*Primary Examiner*—Deborah L. Kyle

*Assistant Examiner*—John E. Griffiths

*Attorney, Agent, or Firm*—Fitch, Even, Tabin & Flannery

[57] ABSTRACT

A rail gun barrel includes a pair of insulators which are axially prestressed in compression.

5 Claims, 5 Drawing Figures

FIG. 1
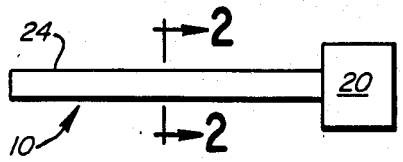
FIG. 5
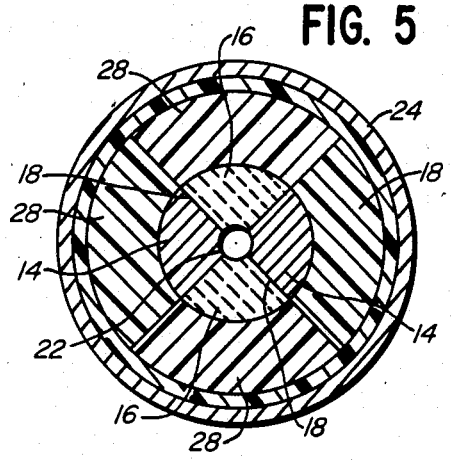
FIG. 2
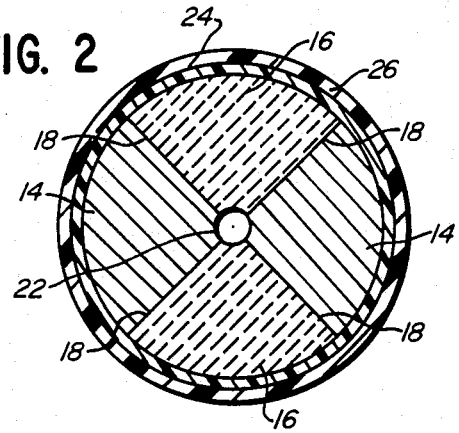
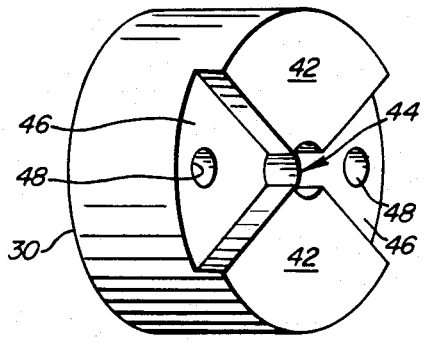
FIG. 4
FIG. 3
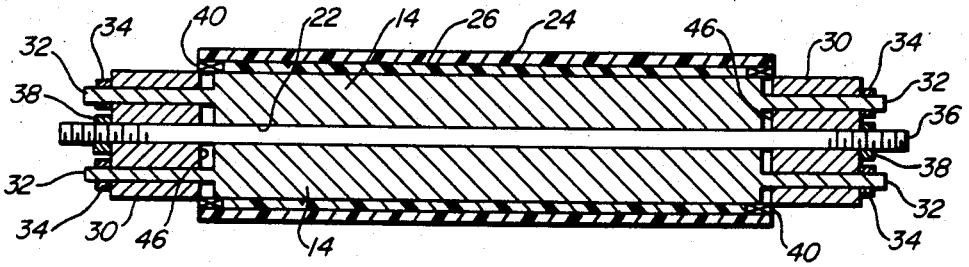

RAIL GUN BARREL WITH AXIALLY PRESTRESSED INSULATORS

BACKGROUND OF THE INVENTION

The present invention relates to a barrel assembly for an electromagnetic rail gun.

One proposed rail gun, described in copending U.S. patent application Ser. No. 506,430, which has been assigned commonly with the present application, includes an elongated barrel which has a pair of longitudinally extending parallel conductors or rails disposed symmetrically about its axis. The rails are separated from one another by elongated insulating members disposed circumferentially between the rails. The rails and insulators are disposed within an elongated tube and prestressed by a pressure medium disposed radially outwardly of the rails and insulating members within the tube. In one embodiment, the pressure medium is a resin which is injected as a liquid, pressurized, and cured to solid phase.

The rails are connected at their rearward or breech ends to opposite terminals of a source of direct current. A circuit through the rails may be completed either by a conductor disposed between the rails or by a plasma arc between the rails. This results in the flow of current which generates magnetic flux between the rails. The flux cooperates with the current in the conductor or the plasma to accelerate the conductor or plasma forward between the rails. The projectile may include the conductor or may be positioned forward of the conductor or plasma arc and driven forward thereby.

In addition to accelerating the projectile forward, electromagnetic forces generated during firing of the rail gun include bursting forces which push outwardly on the rails. Additional bursting forces, acting on both the rails and the insulators, may result from gas pressure generated in the barrel during firing. The gas pressure may be particularly high in barrels of rail guns wherein a plasma arc completes the circuit between the rails, due to the vaporization of metal during the initiation of the arc. Past attempts to construct rail gun barrels suitable for firing projectiles at high velocity have often been unsuccessful, largely due to inability of the barrel components to withstand the bursting forces during firing. Various types of failures may occur during firing, and the nature of the various stresses acting on the barrel during firing has not been entirely understood.

SUMMARY OF THE INVENTION

One aspect of the invention is the discovery that axial tensile stresses may be generated in the insulators during firing and cause the insulators to fail. In the rail gun barrel of the invention, the insulators are axially prestressed in compression to prevent such failure. In manufacturing the barrel, external means apply axial compression to the insulators, and radial compression is subsequently applied via the pressure medium. Once the pressure medium is cured, external axial compression forces are no longer required, as the frictional forces acting on the insulators along their lengths due to their contact with adjacent barrel components maintain the axial compression.

BRIEF DESCRIPTION OF THE DRAWINGS

FIG. 1 is a diagrammatic elevational view of a barrel in accordance with one embodiment of the invention.

FIG. 2 is a transverse sectional view taken substantially along line 2—2 in FIG. 1 and shown on an enlarged scale.

FIG. 3 is a longitudinal sectional view illustrating a step in assembling the barrel of FIGS. 1 and 2.

FIG. 4 is a perspective view of a clamping member for use in assembling the barrel of FIGS. 1 and 2.

FIG. 5 is a transverse sectional view of a barrel in accordance with a second embodiment of the invention.

DETAILED DESCRIPTION OF PREFERRED EMBODIMENTS

The present invention is embodied in a rail gun barrel defining an elongated bore for passage of a projectile. The preferred rail gun barrel 10 includes a pair of elongated, generally parallel, electrically conductive rails 14 and a pair of elongated, generally parallel insulators 16. The insulators 16 are disposed circumferentially between the rails 14. That is, the rails 14 and insulators 16 are disposed alternately about the circumference of the barrel 10 so that the rails 14 do not contact one another. The rails 14 are preferably made of a copper alloy. The insulators 16 herein are made of a ceramic material.

The rails 14 are disposed symmetrically about the longitudinal axis of the barrel, as are the insulators 16. Each rail 14 has a pair of generally planar side surfaces which abut generally planar side surfaces of the insulators 16 at interfaces 18 which define radial planes. The rails 14 are electrically connected at their respective rearward or breech ends to opposite terminals of a source of direct current (not shown). Means 20 for loading projectiles into the barrel 10 are provided at the breech end. The rails 14 may have passages (not shown) formed in them for coolant flow.

The rails 14 and insulators 16 herein define a substantially cylindrical bore 22 through which the projectile (not shown) travels. More specifically, the rails 14 and insulators 16 have curved inner surfaces which collectively define the substantially cylindrical bore 22. The bore 22 may be of circular cross section as shown, or may alternatively be of rectangular or other suitable cross section.

The rails and insulators are constrained by a pressure medium 26 which applies pressure radially inwardly on them. In the embodiment of FIGS. 2 and 3, the pressure medium 26 is contained within a high strength, lightweight tube 24 made of a nonconductive material. The pressure medium 26 is preferably injected as a liquid, pressurized to prestress the rails and insulators, and changed to solid phase without substantial loss of volume to maintain the radial prestressing forces on the rails 14 and insulators 16. The illustrated pressure medium 26 is a thermosetting resin.

In the embodiment of FIG. 5, the tube 24 is made of metal and backing members 28 are provided within the tube 24, outside of the rails 14 and insulators 16, to maintain adequate spacing between the rails and the tube. A circuit through the rails 14 may be completed either by a conductor or a plasma arc disposed between the rails. Where a plasma arc is used, high fluid pressures are generated within the bore 22 by vaporization of a strip of metal. As current flows through the circuit, magnetic flux is generated between the rails 14. The magnetic flux cooperates with the current in the conductor or plasma arc to accelerate the conductor or plasma forward between the rails 14. The projectile may include the conductor or may be positioned forward of the conductor or plasma arc and driven forward thereby.

When the rail gun is fired, bursting forces resulting from the interaction of the current in the rails 14 with the magnetic flux generated thereby urge the rails 14 outwardly. In addition, where a plasma arc is present within the bore 22, high fluid pressures urge both the rails 14 and insulators 16 radially outward.

The bursting forces are not uniform along the length of the barrel, but rather act only on the portion of the barrel behind the projectile. Thus, at any point in time during firing, each of the internal barrel components 14, 16 has a highly stressed region behind the projectile and a less stressed region ahead of the projectile. The tube 24 and pressure medium 26 prevent the rails 14 and insulators 16 from being displaced radially outward, but it has been found that the inner surfaces of the rails and insulators may be displaced outward by compression of these components. The above-described stress pattern thus may instantaneously compress rearward portions of the rails 14 and insulators 16 more than forward portions thereof, generating bending moments along the inner surfaces of the rails 14 and insulators 16 which define the bore 22. The tensile stresses attendant to the bending moments in the rails are generally not of sufficient magnitude to damage the rails, but those in the insulators, which are preferably made of a ceramic material having very good electrical insulating properties, may cause cracking because such ceramic materials typically have low tensile strength and are relatively brittle.

In accordance with the invention, the insulators 16 are prestressed axially so that bursting forces acting thereon during firing which would otherwise produce axial tensile stresses near the inner surfaces thereof instead simply diminish the magnitude of the axial compressive stresses near the inner surfaces. The axial compressive prestressing of the insulators 16 is preferably accomplished by applying axial compressive force to the ends of the insulators 16 by external clamping members 30 after positioning the barrel components in the shell but before prestressing with radial compression. Thus, as the insulators 16 are compressed, they can slide relative to the adjacent barrel components. When the pressure medium 26 is injected and cured to apply radial compression to the rails 14 and insulators 16, the static friction due to the engagement of the insulators by the rails 14 and pressure medium 26 or backing members 28 prevents movement of the insulators 16 relative thereto and thereby maintains axial compressive stress on the insulators so that application of force by the external means 30 is no longer required.

Of course, when the clamping members 30 are removed, some relaxation of the compressive axial prestressing on the insulators 16 may occur because, although the frictional forces between the insulators 16 and the adjacent components will substantially preclude any sliding therebetween, the adjacent components are subject to axial strain, permitting the insulators 16 to partially relax and elongate slightly.

To reduce such relaxation, the rails 14 may be axially prestressed in tension. To this end, the rails 14 may be used to axially support the clamping members 30 during axial prestressing of the insulators 16. In the illustrated embodiment, each rail 14 has a pair of threaded studs 32 projecting from its ends for engaging the clamping members 30. Nuts 34 may be tightened on the studs 32 to exert axial pressure on the insulators 16 through the clamping members 30 while simultaneously tensioning the rails 14. When the pressure medium 26 is pressurized and hardened, the rails 14 are longitudinally prestressed in tension and the insulators 16 are longitudinally prestressed in compression.

An alternative or additional means of axially supporting the clamping members 30 may be provided by a rod 36 extending through the bore 22 of the barrel 10. The illustrated rod 36 is threaded at its ends so that nuts 38 may be employed to exert inwardly directed axial force on the clamping members 30 while tensioning the rod 36.

As illustrated in FIG. 4, each of the preferred clamping members 30 has a pair of inwardly facing lands 42 thereon for engaging the insulators 16 to apply axial pressure thereto. Each of the lands 42 has a shape corresponding to the cross section of its associated insulator 16. Each clamping member 30 has a central bore 44 for receiving the rod 36. Recesses 46 between the lands 42 are spaced from the ends of the rails 14 and have bores 48 extending therethrough to accommodate the studs 32 at the ends of the rails.

Sealing rings 40 are provided at the ends of the barrel 10 between the tube 24 and the clamping members 30 to retain the pressure medium 26 prior to curing thereof. After curing of the pressure medium, the clamping members 30 and rod 36 may be removed from the barrel 10, and the ends of the barrel 10 may be cut off.

From the foregoing it will be appreciated that the invention provides an improved rail gun barrel and an improved method of manufacturing rail gun barrels. While preferred embodiments have been described and illustrated, the invention is not limited to these or any particular embodiments.

What is claimed is:

1. A rail gun barrel defining an elongated bore, said barrel comprising:

a pair of elongated, generally parallel conductive rails extending along opposite sides of said bore and being symmetrical abut a longitudinal axis of the bore;

a pair of elongated insulators disposed generally coextensively with said rails and circumferentially between them;

a pressure medium disposed about said rails and insulators;

an elongated tube generally coextensive with said rails and said insulators and containing said rails and insulators and said pressure medium;

said insulators being axially prestressed in compression;

said rails being axially prestressed in tension;

said rails and insulators being radially prestressed in compression.

2. A rail gun barrel in accordance with claim 1 wherein said pressure medium is a thermosetting resin.

3. A method of manufacturing a rail gun barrel comprising the steps of:

forming a pair of elongated rails;

forming a pair of elongated insulators configured to interfit with said rails to define an elongated bore;

placing said rails and insulators within an elongated tube to define an elongated barrel;

applying axial compression to said insulators by external means to prestress them;

applying axial tension to said rails to prestress them in tension;

applying radial compression to said rails and insulators to radially prestress them after said application of axial compression to said insulators and said application of axial tension to said rails; and ceasing application of axial compression to said insulators by external means after said application of radial compression.

4. A method in accordance with claim 3 wherein the steps of axially prestressing said rails and said insulators comprise employing the rails to axially support clamping members applying axial compression to said insulators.

5. A method in accordance with claim 3 wherein the step of radially prestressing said rails and insulators comprises injection of a liquid into said barrel outside of said rails and insulators and inside of said tube, pressurizing said liquid, and curing said liquid to solid phase with substantially no decrease in volume.

* * * * *